US005881942A

United States Patent [19]

Bergamini

[11] Patent Number: 5,881,942

[45] Date of Patent: Mar. 16, 1999

[54] WIRE SHELF DRIVER

[76] Inventor: Alan R. Bergamini, 2207 Ave. A, Newportville, Pa. 19056

[21] Appl. No.: 936,948

[22] Filed: Sep. 25, 1997

[51] Int. Cl.[6] ..... B25C 1/02

[52] U.S. Cl. ..... 227/132; 227/129; 227/142; 227/146

[58] Field of Search ..... 227/132, 129, 227/146, 142

[56] References Cited

U.S. PATENT DOCUMENTS

| | | | |
|---|---|---|---|
| 1,824,399 | 9/1931 | Graffious | 227/146 |
| 1,900,683 | 3/1933 | Allen | 227/146 |
| 3,203,610 | 8/1965 | Farrell | 227/146 |
| 4,778,094 | 10/1988 | Fishback | 227/132 |
| 5,131,580 | 7/1992 | Allman | 227/132 |

*Primary Examiner*—John Sipos
*Assistant Examiner*—Steven Jensen

[57] ABSTRACT

A mechanical driver is provided including a gun-shaped housing having a horizontal upper extent and a vertical lower extent integrally coupled to the upper extent and extending downwardly therefrom. The upper extent has a nozzle. A spring biased actuator rod is slidably situated within the nozzle of the upper extent of the housing. A spring assembly is included for biasing the actuator rod forwardly. A trigger assembly is provided including a trigger hingably coupled to the lower extent of the housing. The trigger is adapted to swivel between an unbiased vertical orientation and a biased rear tilted orientation, whereby the trigger is adapted to bias the actuator rod rearward and further release the same such that the actuator rod drives forwardly within the nozzle.

7 Claims, 2 Drawing Sheets

WIRE SHELF DRIVER

BACKGROUND OF THE INVENTION

1. Field of the Invention

The present invention relates to nail guns and more particularly pertains to a new wire shelf driver for driving a nail into drywall to secure a shelf bracket thereto.

2. Description of the Prior Art

The use of nail guns is known in the prior art. More specifically, nail guns heretofore devised and utilized are known to consist basically of familiar, expected and obvious structural configurations, notwithstanding the myriad of designs encompassed by the crowded prior art which have been developed for the fulfillment of countless objectives and requirements.

Known prior art nail guns include U.S. Pat. No. 4,999,914; U.S. Pat. No. 5,261,588; U.S. Pat. No. Des. 314,320; U.S. Pat. No. 4,450,998; U.S. Pat. No. 4,204,622; and U.S. Pat. No. 5,335,839.

The wire shelf driver according to the present invention substantially departs from the conventional concepts and designs of the prior art, and in so doing provides an apparatus primarily developed for the purpose of driving a nail into drywall to secure a shelf bracket thereto.

SUMMARY OF THE INVENTION

In view of the foregoing disadvantages inherent in the known types of nail guns now present in the prior art, the present invention provides a new wire shelf driver construction wherein the same can be utilized for driving a nail into drywall to secure a shelf bracket thereto.

The general purpose of the present invention, which will be described subsequently in greater detail, is to provide a new wire shelf driver apparatus and method which has many of the advantages of the nail guns mentioned heretofore and many novel features that result in a new wire shelf driver which is not anticipated, rendered obvious, suggested, or even implied by any of the prior art nail guns, either alone or in any combination thereof.

To attain this, the present invention generally comprises a hollow plastic gun-shaped housing having a horizontal upper extent and a vertical lower extent. The vertical lower extent is integrally coupled to the upper extent and extends downwardly and forwardly therefrom. As shown in FIG. 3, the lower extent has an open front face. The upper extent is equipped with a rigid metal nozzle having a generally cylindrical configuration and an annular flange integrally coupled to an outer surface thereof. Such flange extends outwardly from the nozzle for coupling with a front end of the upper extent of the housing. An internal bore of the nozzle is defined by an outboard extent with a first diameter and an inboard extent with a second diameter less than the first diameter. Slidably situated within the bore of the nozzle of the housing is an actuator rod. The actuator rod has the second diameter. A stopper is fixedly coupled to a central extent of the actuator rod. As shown in FIGS. 2 & 3, the stopper has an outboard extent with a large diameter and an inboard extent having a small diameter which is larger than the second diameter. Also provided is a spring assembly including a hollow cylindrical tube situated within the upper extent of the housing at a rear end thereof. A threaded bore is formed in the rear end of the housing in concentric relationship with the tube. A movable spring container includes a base having a cylindrical configuration with a circular face and a tubular periphery coupled thereto and extending forwardly therefrom. The base is slidably situated within the tube of the spring assembly. A threaded bolt is provided having a first end rotatably coupled to the circular face of the base thereof and a second end situated exterior of the housing with a knurled knob fixedly coupled thereto. An intermediate threaded extent of the bolt is threadedly coupled to the threaded bore of the housing. By this structure, the movably spring container may be manually moved along an axis of the tube. A spring assembly spring has a first end situated about the actuator rod in abutment with the stopper and a second end situated within the base of the movable spring container. As such, a user is permitted to determine the amount of force applied to the actuator rod by the spring. With continuing reference to FIGS. 2 & 3, a trigger assembly is provided including a trigger having bottom face hingably coupled to a bottom of the lower extent within the open front face thereof. A return spring is situated between the lower extent of the housing and a rear face of the trigger. During use, the trigger serves to swivel between an unbiased vertical orientation and a biased rear tilted orientation. As shown in great detail in FIG. 4, a driver mechanism is situated within a vertically oriented bore formed in a top face of the trigger. The bore has a diametrically situated rod coupled therein. A tang is provided having an upper extent with an arcuate front face and a vertical rear face. A lower cylindrical extent of the tang is equipped with an elongated slot formed therein such that the lower cylindrical extent is slidably situated within the vertically oriented bore with the elongated slot encompassing the diametrically situated rod. A spring is situated within the bore below the tang by which the tang has an unbiased raised orientation and a biased lowered orientation. During use, when the trigger is in the unbiased vertical orientation, the tang is in the unbiased raised orientation thereof and the rear face of the upper extent thereof abuts the stopper. Upon the depression of the trigger so that it is transferred to the rear tilted orientation thereof, the actuator rod is biased rearward until the tang disengages the stopper. When disengaged, the actuator drives forward with a force commensurate with the position of the movable spring container. Upon the release of the trigger to the unbiased vertical orientation thereof, the front face of the tang abuts the stopper thereby transferring the same to the biased lowered orientation thereof. This allows the rear face of the tang to again abut the stopper for further use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wire shelf driver apparatus and method which has many of the advantages of the nail guns mentioned heretofore and many novel features that result in a new wire shelf driver which is not anticipated, rendered obvious, suggested, or even implied by any of the prior art nail guns, either alone or in any combination thereof.

It is another object of the present invention to provide a new wire shelf driver which may be easily and efficiently manufactured and marketed.

It is a further object of the present invention to provide a new wire shelf driver which is of a durable and reliable construction.

An even further object of the present invention is to provide a new wire shelf driver which is susceptible of a low cost of manufacture with regard to both materials and labor, and which accordingly is then susceptible of low prices of sale to the consuming public, thereby making such wire shelf driver economically available to the buying public.

Still yet another object of the present invention is to provide a new wire shelf driver which provides in the apparatuses and methods of the prior art some of the advantages thereof, while simultaneously overcoming some of the disadvantages normally associated therewith.

Still another object of the present invention is to provide a new wire shelf driver for driving a nail into drywall to secure a shelf bracket thereto.

Even still another object of the present invention is to provide a new wire shelf driver that includes a gun-shaped housing having a horizontal upper extent and a vertical lower extent integrally coupled to the upper extent and extending downwardly therefrom. The upper extent has a nozzle. A spring biased actuator rod is slidably situated within the nozzle of the upper extent of the housing. A spring assembly is included for biasing the actuator rod forwardly. A trigger assembly is provided including a trigger hingably coupled to the lower extent of the housing. The trigger is adapted to swivel between an unbiased vertical orientation and a biased rear tilted orientation, whereby the trigger is adapted to bias the actuator rod rearward and further release the same such that the actuator rod drives forwardly within the nozzle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
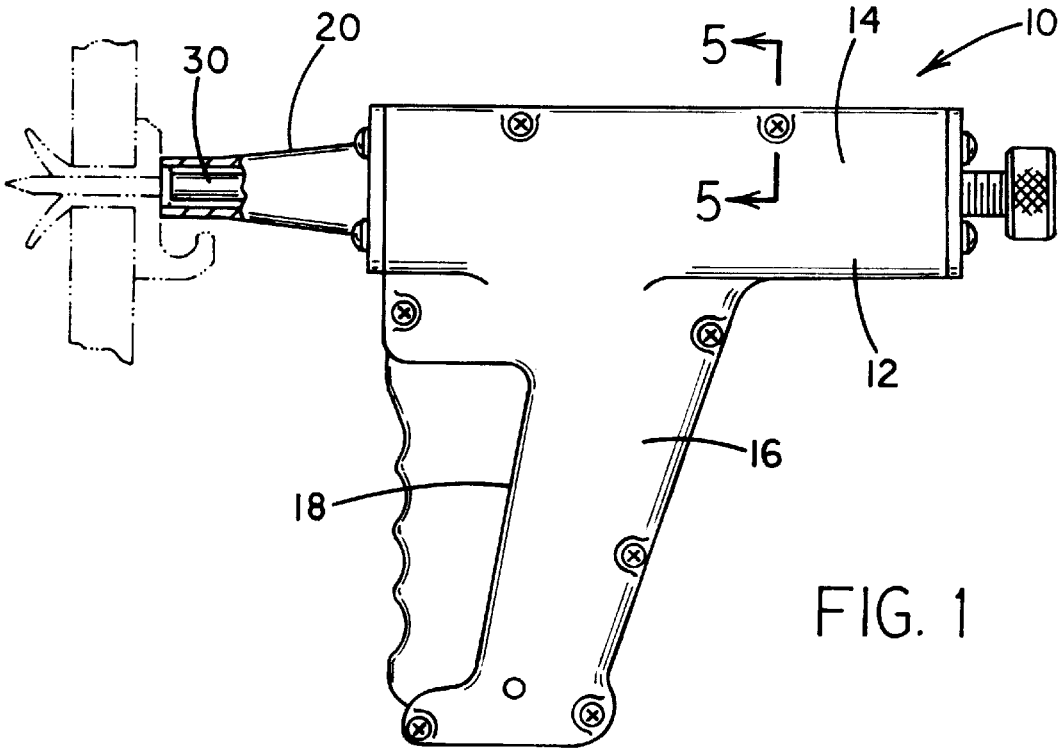
FIG. 1 is a side view of a new wire shelf driver according to the present invention.

With reference now to the drawings, and in particular to FIGS. 1 through 5 thereof, a new wire shelf driver embodying the principles and concepts of the present invention and generally designated by the reference numeral 10 will be described.

The present invention, as designated as numeral 10 includes a hollow plastic gun-shaped housing 12 having a horizontal upper extent 14 and a vertical lower extent 16. The vertical lower extent is integrally coupled to the upper extent and extends downwardly and forwardly therefrom. As shown in FIG. 1, the lower extent has an open front face 18. In the preferred embodiment, the housing is defined by two opposed halves screwably coupled together.

The upper extent is equipped with a rigid metal nozzle 20 having a generally cylindrical configuration and an annular flange 22 integrally coupled to an outer surface thereof. Such flange extends outwardly from the nozzle for coupling with a front end of the upper extent of the housing. An internal bore 24 of the nozzle is defined by an outboard extent 26 with a first diameter and an inboard extent 28 with a second diameter less than the first diameter.

Figure 2:
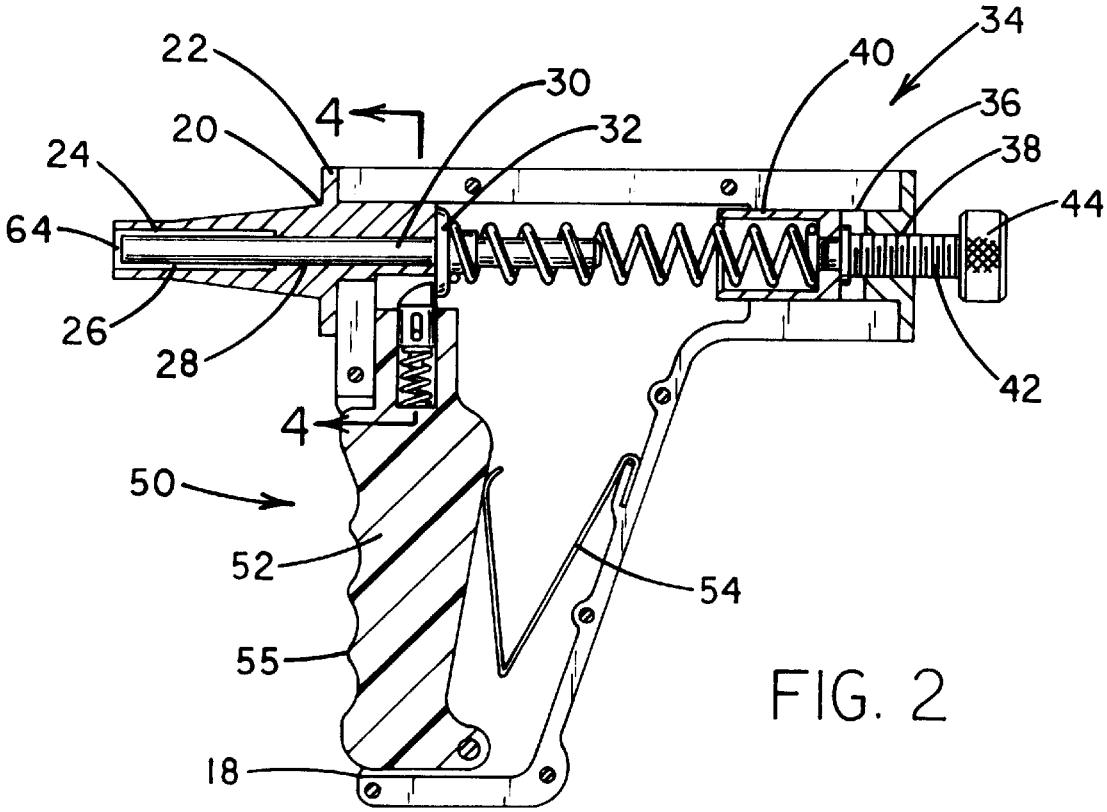
FIG. 2 is a side cross-sectional view of the present invention with the trigger, driver mechanism and actuator rod in the unbiased orientation.
Figure 3:
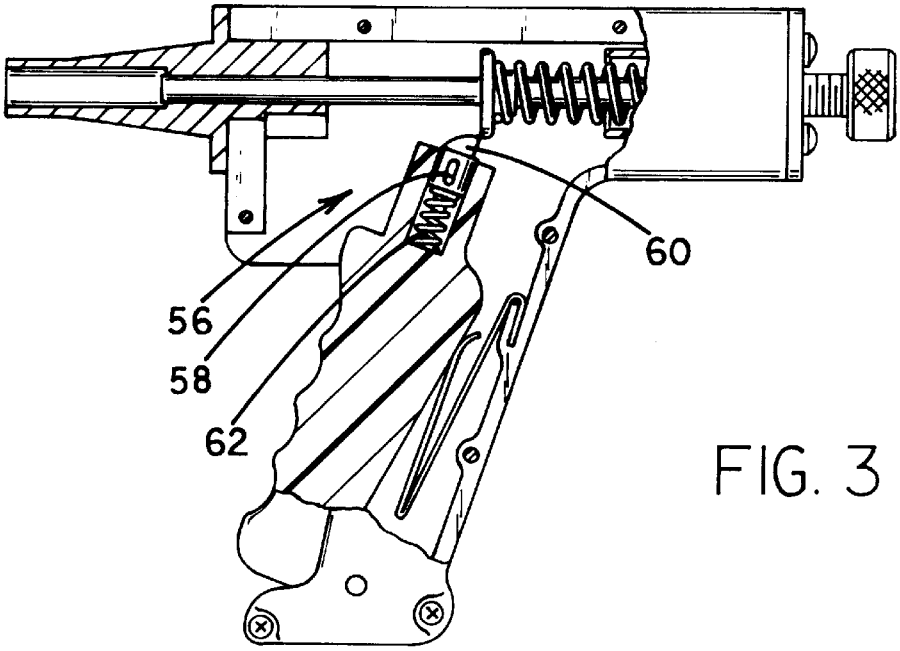
FIG. 3 is a side cross-sectional view of the present invention with the trigger and actuator rod in the biased orientation.

Slidably situated within the bore of the nozzle of the housing is an actuator rod 30. The actuator rod has the second diameter. A stopper 32 is fixedly coupled to a central extent of the actuator rod. As shown in FIGS. 2 & 3, the stopper has an outboard extent with a large diameter and an inboard extent having a small diameter which is larger than the second diameter.

Also provided is a spring assembly 34 including a hollow cylindrical tube 36 situated within the upper extent of the housing at a rear end thereof. A threaded bore 38 is formed in the rear end of the housing in concentric relationship with the tube. A movable spring container 40 includes a base having a cylindrical configuration with a circular face and a tubular periphery coupled thereto and extending forwardly therefrom. The base is slidably situated within the tube of the spring assembly. A threaded bolt 42 is provided having a first end rotatably coupled to the circular face of the base and a second end situated exterior of the housing with a knurled knob 44 fixedly coupled thereto. An intermediate threaded extent of the bolt is threadedly coupled to the threaded bore of the housing.

By this structure, the movably spring container may be manually moved along an axis of the tube. A spring of the spring assembly has a first end situated about the actuator rod in abutment with the stopper and a second situated within the base of the movable spring container. As such, a user is permitted to determine the amount of force applied to the actuator rod by the spring.

With continuing reference to FIGS. 2 & 3, a solid plastic trigger 50 assembly is provided including a trigger 52 having bottom face hingably coupled to a bottom of the lower extent of the housing within the open front face thereof. A return spring 54 is situated between the lower extent of the housing and a rear face of the trigger. The return spring preferably has a V-shaped configuration. During use, the trigger serves to swivel between an unbiased vertical orientation and a biased rear tilted orientation. An upper front extent of the trigger abuts triggering to prevent the trigger from exiting the housing. Ideally, a front face of the trigger has a plurality of finger receiving undulations 55 formed therein.

Figure 4:
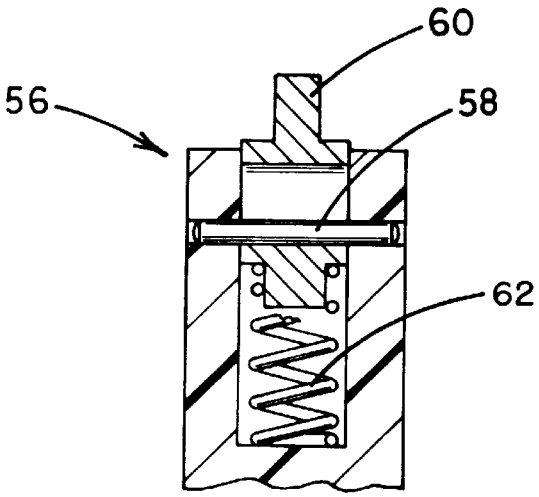
FIG. 4 is a detailed cross-sectional view of the driver mechanism of the present invention.
Figure 5:
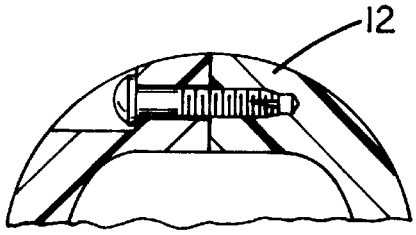
FIG. 5 is a cross-sectional view of the present invention taken along line 5—5 shown in FIG. 1.

As shown in great detail in FIG. 4, a driver mechanism 56 is situated within a vertically oriented bore formed in a top face of the trigger. The bore has a diametrically situated rod 58 coupled therein. A tang 60 is provided having an upper extent with an arcuate front face and a vertical rear face. A lower cylindrical extent of the tang is equipped with an elongated slot formed therein such that the lower cylindrical extent is slidably situated within the vertically oriented bore with the elongated slot encompassing the diametrically situated rod. It should be understood that the interrelationship of the diametrically situated rod and the slot formed in the tang constrains the movement of the tang. A spring 62 is situated within the bore below the tang by which the tang has an unbiased raised orientation and a biased lowered orientation.

During use, when the trigger is in the unbiased vertical orientation, the tang is in the unbiased raised orientation thereof and the rear face of the upper extent thereof abuts the stopper. Upon the depression of the trigger so that it is transferred to the rear tilted orientation thereof, the actuator rod is biased rearward until the tang disengages the stopper. When disengaged, the actuator drives forward with a force commensurate with the position of the movable spring container. This force is preferably directed upon a nail situated within the nozzle prior to the depression of the trigger. A small space 64 is situated between an end of the nozzle and the actuator rod when in the unbiased orientation thereof for receiving a head of the nail.

Upon the release of the trigger to the unbiased vertical orientation thereof, the front face of the tang abuts the stopper thereby transferring the same to the biased lowered orientation thereof. This allows the rear face of the tang to again abut the stopper for further use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mechanical driver comprising, in combination:

a hollow plastic housing having a first extent and a second extent integrally coupled to the first extent and extending downwardly and forwardly therefrom, the second extent having an open front face, the first extent having a rigid metal nozzle with a generally cylindrical configuration and an annular flange integrally coupled to an outer surface thereof and extending outwardly therefrom for coupling with a front end of the first extent of the housing, the nozzle having an internal bore with an outboard extent with a first diameter and an inboard extent with a second diameter less than the first diameter;

an actuator rod having the second diameter slidably situated within the bore of the nozzle of the housing, the actuator rod having a stopper fixedly coupled to a central extent thereof and having an outboard extent with a large diameter and an inboard extent having a small diameter which is larger than the second diameter;

a spring assembly including a hollow cylindrical tube situated within the first extent of the housing at a rear end thereof, a threaded bore formed in the rear end of the housing in concentric relationship with the tube, and a movable spring container including a base having a cylindrical configuration with a circular face and a tubular periphery coupled thereto and extending forwardly therefrom, wherein the base is slidably situated within the tube of the spring assembly, the movable spring container further including a threaded bolt having a first end rotatably coupled to the circular face of the base thereof, a second end situated exterior of the housing with a knurled knob fixedly coupled thereto, and an intermediate threaded extent threadedly coupled to the threaded bore of the housing such that the movable spring container may be manually moved along an axis of the tube, wherein a spring of the spring assembly has a first end situated about the actuator rod in abutment with the stopper and a second end situated within the base of the movable spring container thereby allowing a user to determine the amount of force applied to the actuator rod by the spring;

a trigger assembly including a trigger having bottom face hingably coupled to a bottom of the second extent within the open front face thereof with a return spring situated between the second extent of the housing and a rear face of the trigger, wherein the trigger is adapted to swivel between an unbiased vertical orientation and a biased rear tilted orientation;

a driver mechanism including a vertically oriented bore formed in a top face of the trigger with a diametrically situated rod coupled therein, a tang having a first extent with an arcuate front face and a vertical rear face and a second extent with an elongated slot formed therein such that the second extent of the tang is slidably situated within the vertically oriented bore with the elongated slot encompassing the diametrically situated rod, and a driver spring situated within the bore below the tang, wherein the tang has an unbiased raised orientation and a biased lowered orientation;

wherein when the trigger is in the unbiased vertical orientation, the tang is in the unbiased raised orientation thereof and the rear face of the first extent thereof abuts the stopper, wherein upon the depression of the trigger so that it is transferred to the rear tilted orientation thereof, the actuator rod is biased rearward until the tang disengages the stopper at which time the actuator drives forward with a force commensurate with the position of the movable spring container, whereupon the release of the trigger to the unbiased vertical orientation thereof, the front face of the tang abuts the stopper thereby transferring the same to the biased lowered orientation thereof such that the rear face of the tang may again abut the stopper for further use.

2. A mechanical driver comprising:

a housing having a first extent and a second extent integrally coupled to the first extent, the first extent having a nozzle;

an actuator rod slidably situated within the nozzle of the first extent of the housing, wherein the actuator rod is spring biased;

a spring assembly with a spring for biasing the actuator rod forwardly;

a trigger assembly including a trigger hingably coupled to the second extent of the housing, wherein the trigger is adapted to swivel between an unbiased orientation and a biased orientation;

wherein the trigger is adapted to bias the actuator rod rearward and further release the same such that the actuator rod drives forwardly within the nozzle;

wherein the spring assembly includes a hollow tube situated within the first extent of the housing, a threaded bore formed in a rear end of the housing in concentric relationship with the tube, and a movable spring container including a base being slidably situated within the tube of the spring assembly, the movable spring container further including a threaded bolt having a first end rotatable coupled to the base thereof, a second end situated exterior of the housing with a knob fixedly coupled thereto, and an intermediate threaded extent threadedly coupled to the threaded bore of the housing such that the movably spring container may be manually moved along an axis of the tube, the spring having a first end situated about the actuator rod in abutment with a stopper and a second end situated within the base of the movable spring container thereby allowing a user to determine the amount of force applied to the actuator rod by the spring.

3. A mechanical driver as set forth in claim 2 and further including a driver mechanism with a spring biased tang situated on the trigger for biasing the actuator rod rearwardly.

4. A mechanical driver as set forth in claim 3 wherein the tang has an arcuate front face and a vertical rear face.

5. A mechanical driver as set forth in claim 3 wherein the tang engages the stopper fixedly coupled to the actuator rod.

6. A mechanical driver as set forth in claim 2 wherein the housing is plastic and the nozzle is formed of a metal.

7. A mechanical driver comprising:

a housing having a first extent and a second extent integrally coupled to the first extent and extending downwardly therefrom, the first extent having a nozzle;

an actuator rod slidably situated within the nozzle of the first extent of the housing, wherein the actuator rod is spring biased;

a spring assembly with a spring for biasing the actuator rod forwardly and for adjusting the force applied to the actuator rod by the spring;

a trigger assembly including a trigger hingably coupled to the second extent of the housing, wherein the trigger is adapted to swivel between an unbiased vertical orientation and a biased rear tilted orientation;

wherein the trigger is adapted to bias the actuator rod rearward and further release the same such that the actuator rod drives forwardly within the nozzle;

wherein the spring assembly includes a hollow cylindrical tube situated within the first extent of the housing, a threaded bore formed in a rear end of the housing in concentric relationship with the tube, and a movable spring container including a base having a cylindrical configuration with a circular face and a tubular periphery coupled thereto and extending forwardly therefrom, the base being slidably situated within the tube of the spring assembly, the movable spring container further including a threaded bolt having a first end rotatably coupled to the circular face of the base thereof, a second end situated exterior of the housing with a knurled knob fixedly coupled thereto, and an intermediate threaded extent threadedly coupled to the threaded bore of the housing such that the movably spring container may be manually moved along an axis of the tube, the spring having a first end situated about the actuator rod in abutment with a stopper and a second end situated within the base of the movable spring container thereby allowing a user to determine the amount of force applied to the actuator rod by the spring.

* * * * *